US007131150B1

(12) United States Patent
Havens

(10) Patent No.: US 7,131,150 B1
(45) Date of Patent: Nov. 7, 2006

(54) DEVICE TO ASSIST P-TRAP DRAINAGE

(76) Inventor: Brian David Havens, 10913 Larson Dr., Northglenn, CO (US) 80233

( * ) Notice: Subject to any disclaimer, the term of this patent is extended or adjusted under 35 U.S.C. 154(b) by 0 days.

(21) Appl. No.: 10/605,316

(22) Filed: Sep. 14, 2005

(51) Int. Cl.
*E03C 1/26* (2006.01)

(52) U.S. Cl. ..... 4/288; 4/DIG. 14; 4/286

(58) Field of Classification Search ..... 4/288–292, 4/DIG. 14, 256.1, 652
See application file for complete search history.

(56) References Cited

U.S. PATENT DOCUMENTS 4,045,351 A 8/1977 Peterson
4,224,701 A 9/1980 Huang
4,949,406 A 8/1990 Caneli
5,236,137 A 8/1993 Coogan
5,413,705 A 5/1995 Tammera
5,546,614 A * 8/1996 King, II ..... 4/256.1
6,385,799 B1 5/2002 Doyen
6,558,538 B1 5/2003 Scuilla
6,609,259 B1 8/2003 Cantrell

FOREIGN PATENT DOCUMENTS

JP 11-158957 * 6/1999

* cited by examiner

*Primary Examiner*—Huyen Le
(74) *Attorney, Agent, or Firm*—Barber Legal; Craig Barber

(57) ABSTRACT

The device is a molded, chemically-resistant-plastic cylinder consisting of a top rail, a bottom rail, four equally spaced quadrant side bars and four tapered helicoidally twisted directional vanes. Vanes are tapered from top to bottom so as not to collect debris.

1 Claim, 5 Drawing Sheets

DEVICE TO ASSIST P-TRAP DRAINAGE

CROSS REFERENCE TO RELATED APPLICATIONS

U.S. Patent Documents

BACKGROUND OF INVENTION

1. Field of the Invention

This invention relates to a retrofitable plumbing accessory for residential and commercial sink drains. Further this invention relates to the way waste liquids are transported through sink traps.

2. Description of Prior Art

Peterson, U.S. Pat. No. 4,045,351, discloses a kitchen or bathroom strainer device that is mounted beneath the sink and is incorporated in the drain. The elements of this disclosure are not similar to the present invention.

Huang, U.S. Pat. No. 4,224,701 discloses a device that permits a twisting downward discharge of waste water but in no way is similar to the present invention.

Canelli, U.S. Pat. No. 4,949,406, and others, Coogan U.S. Pat. No. 5,236,137, Tammera U.S. Pat. No. 5,413,705 and Doyen, U.S. Pat. No. 6,385,799, all disclose inventions that either strain waste water or use some mechanical means of preventing debris for collecting in the trap or drain system. They in no way are similar to the present invention.

Cantrell, U.S. Pat. No. 6,609,259, discloses a device which does change the direction of the flow of waste liquid as it passes into a drain but again in no way is similar to the present invention.

SUMMARY OF INVENTION

The invention in its current embodiment is designed to assist draining waste liquid through a P-trap by twisting the flow of said liquid through the trap helping to entrain debris thereby helping prevent debris buildup in the trap.

DETAILED DESCRIPTION

Figure 1:
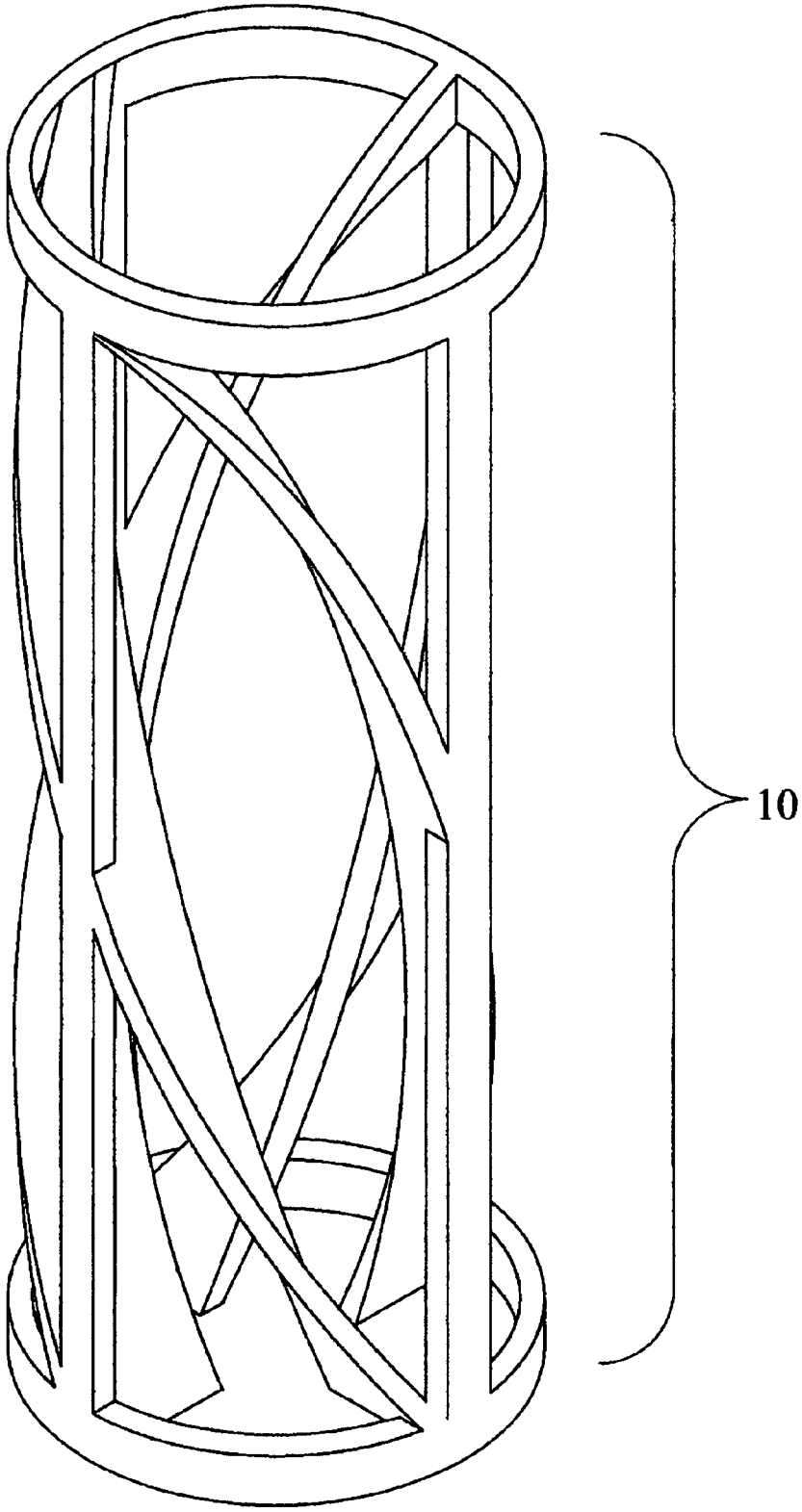
FIG. 1 is a perspective view of the preferred form of the design embodiment.
Figure 2:
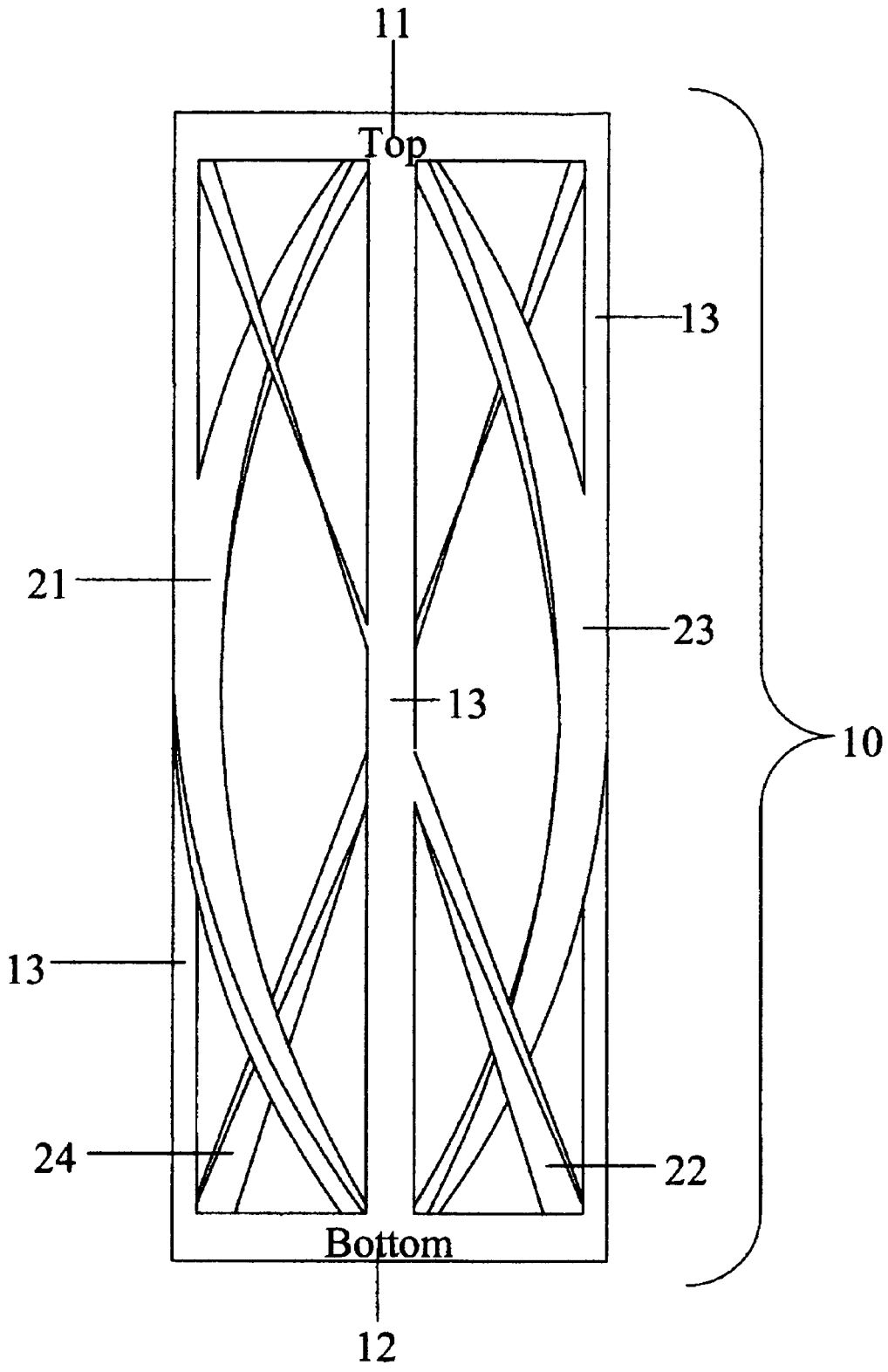
FIG. 2 is a side view of preferred form of the design embodiment.

FIG. 2 shows a side view of the preferred form of the device as a manufactured molded chemically resistant plastic cylinder 10 consisting of a top rail 11 marked "Top", a bottom rail 12 marked "Bottom", four equally spaced quadrant side bars 13 and four tapered helicoidally twisted directional vanes 21, 22, 23 and 24. Vanes are tapered from top to bottom so as not to collect debris.

Figure 3:
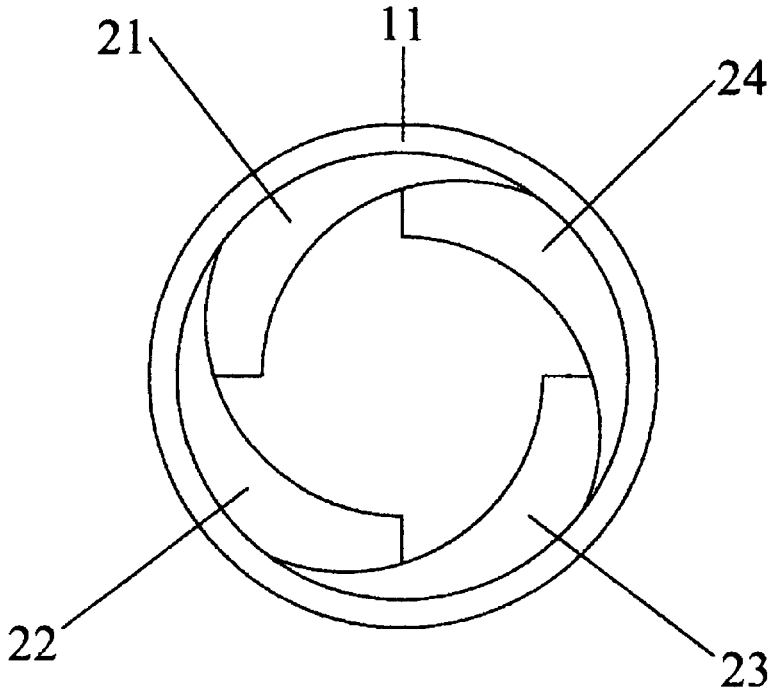
FIG. 3 is a top view of the design embodiment.

FIG. 3 shows a top view of the device with top rail 11 and the four vanes 21, 22, 23 and 24.

Figure 4:
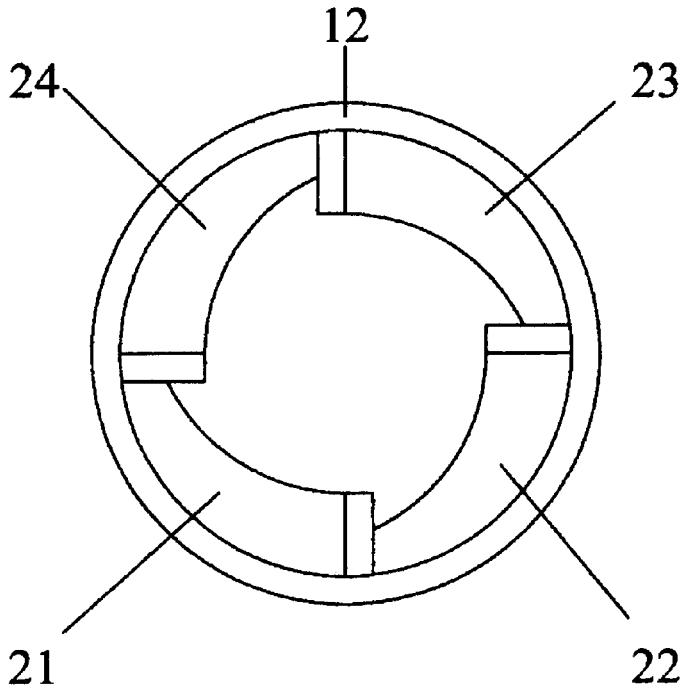
FIG. 4 is a bottom view of the design embodiment.

FIG. 4 shows a bottom view of the device with bottom rail 12 and the four vanes 21, 22, 23 and 24.

Figure 5:
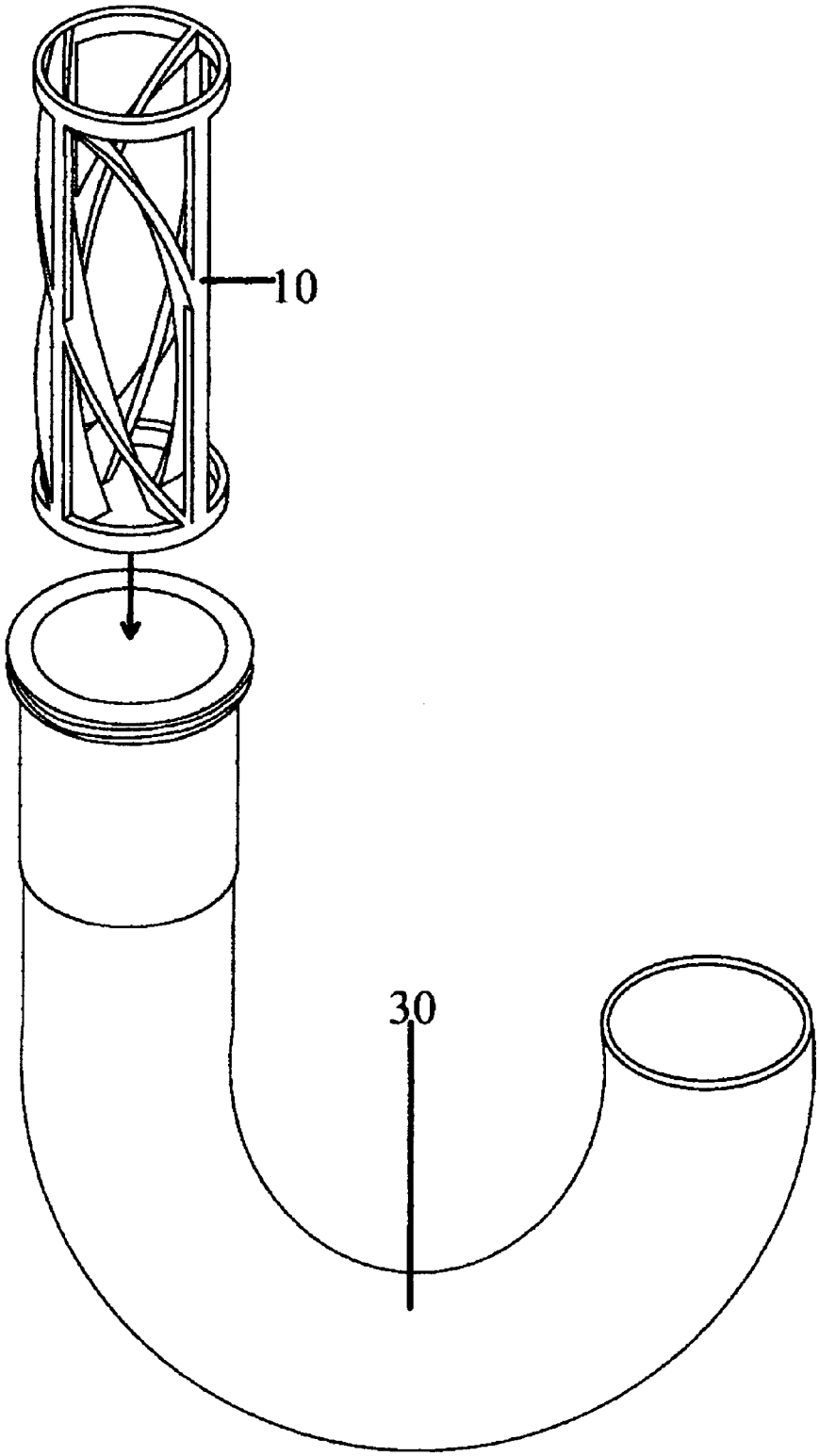
FIG. 5 shows the design embodiment before insertion in a P-trap.

FIG. 5 shows the device 10 ready to install in a P-trap 30.

Figure 6:
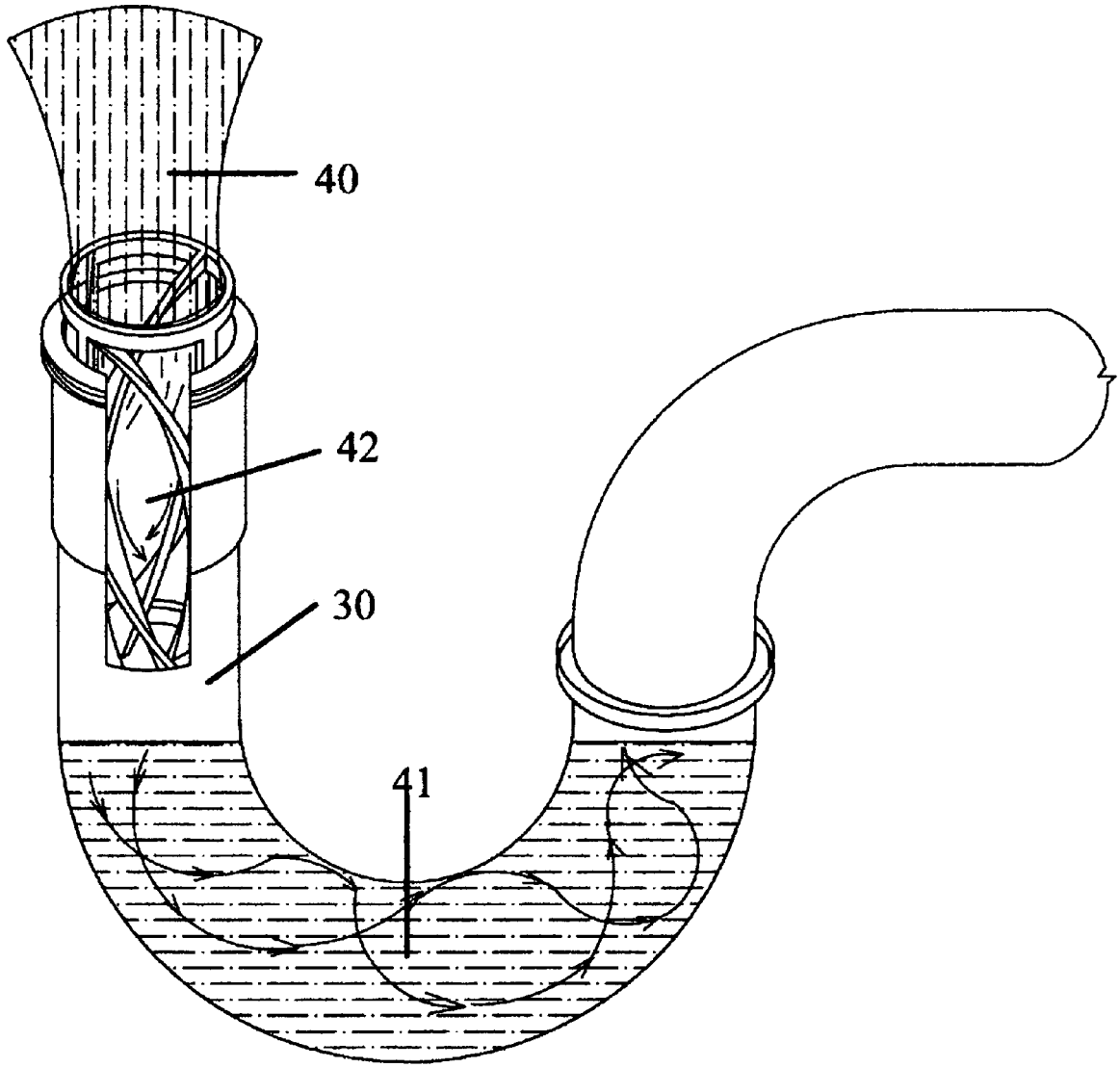
FIG. 6 shows the design embodiment in a P-trap with draining liquid.

FIG. 6 shows the device 10 in cutaway view with draining liquid 40, spinning liquid 42, P-trap 30 and trap liquid 41 as disturbed by sinning liquid 42.

In the foregoing description, certain terms have been used for brevity, clearness and understanding:; but no unnecessary limitations are to be implied there from beyond the requirements of the prior art, because such terms are used for descriptive purposes and are intended to be broadly construed. Moreover, the description pand illustration of the invention is by way of example, and the scope of the invention is not limited to the exact details shown or described.

The invention claimed is:

1. A device manufactured of molded chemically resistant device insert-able into the sink drain consisting of: a top rail, a bottom rail, four equally spaced quadrant side bars and four tapered helicoidally twisted directional vanes tapered from top to bottom so as to avoid collecting debris from the draining liquids.

* * * * *